US007518577B2

(12) United States Patent
Akimoto et al.

(10) Patent No.: US 7,518,577 B2
(45) Date of Patent: Apr. 14, 2009

(54) IMAGE DISPLAY DEVICE

(75) Inventors: Hajime Akimoto, Kokubunji (JP); Kiyoshige Kinugawa, Mutsusawa (JP); Nobuaki Hayashi, Kunitachi (JP)

(73) Assignee: Hitachi Displays, Ltd., Chiba (JP)

( * ) Notice: Subject to any disclaimer, the term of this patent is extended or adjusted under 35 U.S.C. 154(b) by 453 days.

(21) Appl. No.: 10/894,017

(22) Filed: Jul. 20, 2004

(65) Prior Publication Data

US 2005/0110720 A1 May 26, 2005

(30) Foreign Application Priority Data

Nov. 21, 2003 (JP) ..... 2003-392138

(51) Int. Cl.
*G09G 3/30* (2006.01)

(52) U.S. Cl. ..... 345/76; 315/169.3

(58) Field of Classification Search ..... 345/55, 345/690, 698, 84, 90, 92, 76; 315/169.2, 315/169.3
See application file for complete search history.

(56) References Cited

U.S. PATENT DOCUMENTS 6,501,230 B1 * 12/2002 Feldman ..... 315/169.3
7,088,052 B2 * 8/2006 Kimura ..... 315/169.2
7,158,157 B2 * 1/2007 Yamazaki et al. ..... 345/691
2002/0101395 A1 * 8/2002 Inukai ..... 345/83
2003/0063053 A1 * 4/2003 Yamazaki et al. ..... 345/82
2003/0063081 A1 * 4/2003 Kimura et al. ..... 345/211
2003/0090446 A1 * 5/2003 Tagawa et al. ..... 345/76

FOREIGN PATENT DOCUMENTS

JP 2002-278514 3/2001
JP 2002-341825 5/2001
JP 2003-005709 6/2001
JP 2003-122301 10/2001

* cited by examiner

*Primary Examiner*—Amr Awad
*Assistant Examiner*—Dennis P Joseph
(74) *Attorney, Agent, or Firm*—Reed Smith LLP; Juan Carlos A. Marquez, Esq.

(57) ABSTRACT

An image display device which has a stable luminous brightness among pixels. An on/off control switch 15 for stopping the driving operation of a light emitting element 13 is provided in a pixel 1. A change in the luminous brightness caused by a variation in the characteristic of the light emitting element 13 is suppressed by feeding a result measured by a current measuring circuit provided in one end of a power line 4 back to a drive signal for the light emitting element 13.

12 Claims, 9 Drawing Sheets

IMAGE DISPLAY DEVICE

INCORPORATION BY REFERENCE

The present application claims priority from Japanese application JP 2003-392138 filed on Nov. 21, 2003, the content of which is hereby incorporated by reference into this application.

BACKGROUND OF THE INVENTION

The present invention relates to a high-quality image display device and more particular, to an image display device of a light-emitting flat-panel type such as organic electro-luminescence.

There are various types of such flat-panel type image display devices including a liquid crystal display (LCD), a field emission display (FED), a plasma display panel (PDP), and an organic electro-luminescence (which will also be referred to merely as the organic EL, hereinafter) device, which go into actual use or are still in the research stage of actual use. Of these flat panel type image display devices, self light-emitting and light-emitting flat panel types, where pixel itself emits light, receive much attention. In the LCD or organic EL devices having a pixel circuit of thin-film transistors (TFTs) each formed for each pixel, an active type has been predominantly used.

Explanation will be made as to the arrangement and exemplary operation of a prior art light-emitting flat panel (which will also be referred to merely as the light-emitting display device, hereinafter) as an image display device, with reference to FIGS. 13, 14, and 15. FIG. 13 shows a structure of a prior art light-emitting display device. In the drawing, pixels 201 are provided in a display zone 200 in form of a matrix having rows and columns. And a signal line 202, a gate line 203 and a power line 204 are connected to each pixel 201. Many of the pixels 201 are actually provided in the display zone 200, but only one of the pixels is shown for simplicity of the drawing. The signal line 202 is connected at its one end with a signal voltage input circuit 206, and the gate line 203 is connected at its one end with a shift register circuit 205. The power line 204 is connected at its one end with a power supply circuit 208 via a current measuring circuit 207.

FIG. 14 shows a diagram for explaining an exemplary structure of the pixel 201 in FIG. 13. One end of a first thin-film transistor (pixel TFT) 210 is connected to the signal line 202. A gate of the pixel TFT 210 is connected to the gate line 203, and the other end of the pixel TFT 210 is connected to a gate of a second thin-film transistor (driving TFT) 212. One end of a capacitance 211 is connected to the gate of the driving TFT 212, and the other end of the capacitance 211 is connected to the power line 204 commonly together with one end of the driving TFT 212. The other end of the driving TFT 212 is connected to one end of a light emitting element 213 (organic EL element in the illustrated example), and the other end of the light emitting element 213 is connected to a common grounding terminal 214.

Explanation will next be made as to the operation of the image display device shown in FIGS. 13 and 14. In a regular image display mode, the signal voltage input circuit 206 sequentially outputs a signal voltage to the signal lines 202. In synchronism with it, the shift register circuit 205 continues to select and scan the pixel 201 for the signal voltage to be written therein. During the above operation, power is supplied from the power supply circuit 208 to the power lines 204. When the gate line 203 of the pixel 201 is selected and the pixel TFT 210 is turned ON during the output of the signal voltage to the signal line 202, the signal voltage is written in the capacitance 211. Since the written signal voltage is still stored in the capacitance 211 even after the pixel TFT 210 is turned off, the written signal voltage is always input to the driving TFT 212. This results in that the driving TFT 212 inputs a drive current corresponding to the written signal voltage to the light emitting element 213, and the light emitting element 213 emits light with a brightness corresponding to the signal voltage.

Ideally, the image display should be realized through the above operation without any trouble, but it actually involves a problem that luminous brightness gradually varies with deterioration of the light emitting element 213 with time passage. Since the degree of such deterioration of the light emitting element 213 with time varies from pixel to pixel, the element deterioration generates a fixed burned pattern of noise in the displayed image. To avoid this, the prior art is arranged so that a deterioration in each pixel is measured and the measured deterioration is fed back to the display signal voltage to cancel the aforementioned fixed pattern of noise.

Explanation will be made as to the operation of the prior art image display device of FIG. 13 when a deterioration in each pixel is measured. FIG. 15 shows a diagram for explaining a sequence when a drive current is measured for each pixel row. First, a black level is written into all the pixels 201 by the signal voltage input circuit 206 over a period of one frame.

Thereafter, as the shift register circuit 205 sequentially selects each pixel row, a white level is written by the signal voltage input circuit 206, a drive current for each pixel is measured by the current measuring circuit 207, and a black level is written by the signal voltage input circuit 206. These operations are repeated. Through the repeated operations, the drive current characteristics of all the pixels 201 are measured.

On the basis of a change in the drive current characteristic thus obtained, a degree of deterioration of the light emitting element 213 at each pixel is acquired. The above fixed pattern of noise can be canceled by feeding the acquired result back to the signal voltage. Such a prior art is described in detail, for example, JP-A-2002-278514 and JP-A-2002-341825. Prior arts associated with a pixel circuit in an embodiment to be explained later are disclosed in JP-A-2003-5709 and JP-A-2003-122301.

In the aforementioned prior art, for the purpose of measuring a drive current characteristic corresponding to one pixel row, three sequences (1) to (3) are required. That is, (1) writing of the black and then white level to all the pixels by the signal voltage input circuit 206, (2) measurement of the drive current for each pixel by the current measuring circuit 207, and (3) writing of the black level by the signal voltage input circuit 206, are required. Since accurate writing to the signal line 202 and/or the power line 204 is carried out in any of the three operations, a predetermined writing time becomes necessary. For this reason, for measuring the drive current characteristics of all the pixels, a time as relatively long as one frame or more is required. Thus it is difficult to cancel a variation in the characteristic on a real time basis while a motion image is displayed.

The deterioration of the light emitting element with time advances slowly. Thus the need of measuring a characteristic change on a real time basis should be eliminated. However, from the fact that the characteristic of the light emitting element is sensitive to temperature, we noticed a problem that the characteristic varies with heat generated by the element itself on a real time basis. Since such characteristic variation caused by the temperature change disappears in a certain time, it affects the image quality in the form of a sort of long-time after-image, thus deteriorating the stability of the luminous brightness.

SUMMARY OF THE INVENTION

It is therefore an object of the present invention to cancel a characteristic variation of a light emitting element generated on a real time basis.

The above object is attained by providing an image display device which includes a plurality of pixels each having a light emitting element, a display signal storing circuit, and a circuit for driving the light emitting element with an average brightness corresponding to a display signal stored in the display signal storing circuit;

a display zone having the plurality of pixels arranged in the form of a matrix;

a plurality of power lines for commonly connecting the pixels in a column direction in the display zone and supplying power to the display zone; and a circuit for writing the display signal in the pixels.

In an aspect of the present invention, each of the pixels comprises an on/off control switch for stopping driving operation of the light emitting element provided in the pixel, a current measuring circuit connected to one end of the power line, a pixel current value storing circuit for storing a current value measured by the current measuring circuit, and a circuit for modulating the display signal using the measured current value stored in the pixel circuit value storing circuit.

In accordance with an aspect of the present invention, there can be provided an image display device which has a stable luminous brightness among pixels.

Other objects, features and advantages of the invention will become apparent from the following description of the embodiments of the invention taken in conjunction with the accompanying drawings.

DETAILED DESCRIPTION OF THE EMBODIMENTS

The present invention will be explained in detail in connection with embodiments of the invention with reference to the accompanying drawings.

Embodiment 1

Figure 1:
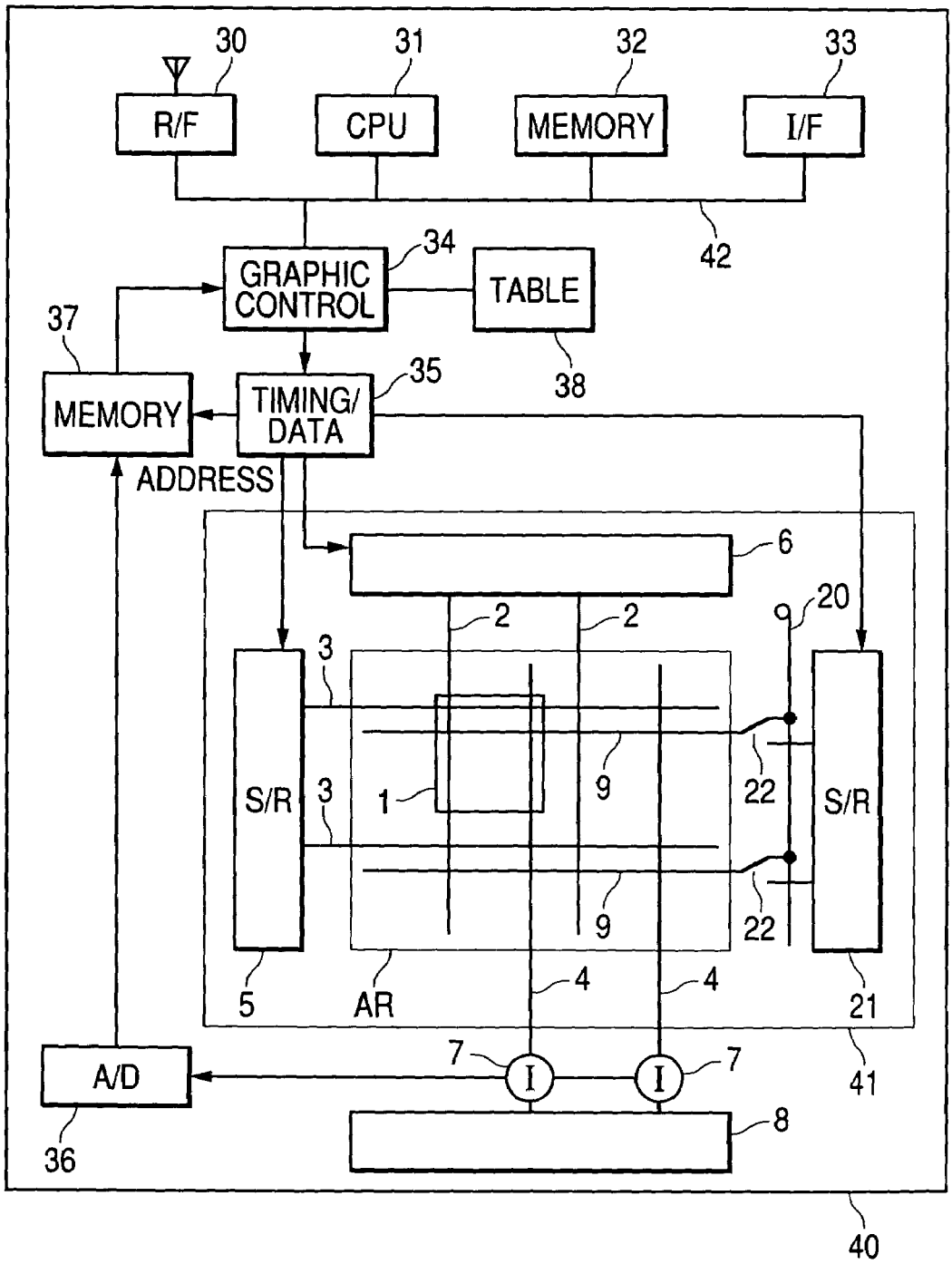
FIG. 1 is an arrangement of a portable terminal as an image display device in accordance with a first embodiment of the present invention.

FIG. 1 shows an arrangement of a portable terminal 40 as an image display device in accordance with first embodiment of the present invention. Pixels 1 are provided in a display zone AR in the form of a matrix having rows and columns. Connected to each of the pixels 1 are a signal line 2, a gate line 3, a power line 4, and an on/off control line 9. Many of such pixels 1 are actually provided in the display zone AR, but only one of the pixels is shown in FIG. 1 for simplicity of the drawing. One end of the signal line 2 is connected to a signal voltage input circuit 6. One end of the gate line 3 is connected to a first shift register circuit 5. One end of the power line 4 is connected to a power supply circuit 8 via a current measuring circuit 7. One end of the on/off control line 9 is connected to a second shift register circuit 21 via an on/off changeover switch 22, and the other end of the on/off changeover switch 22 is connected to an on/off line 20. In this connection, the pixels 1, signal voltage input circuit 6, first shift register circuit 5, on/off changeover switch 22, and second shift register circuit 21 are provided on a glass substrate 41 using polycrystalline Si-TFTs (polycrystalline silicon thin-film transistors).

In the portable terminal 40, a radio interface circuit 30, a CPU (central processing unit) 31, a frame memory 32, and an input interface circuit 33 based on ten keys and a touch panel are connected to a graphic control circuit 34 by a system bus 42. The graphic control circuit 34 is connected with a data conversion table 38. An output of the graphic control circuit 34 is input to a timing control circuit 35. The timing control circuit 35 is connected by control and data lines to the signal voltage input circuit 6, first shift register circuit 5, on/off changeover switch 22, second shift register circuit 21, a correction data memory 37, etc. An output of the current measuring circuit 7 is connected to an A/D conversion circuit 36. An output of the A/D conversion circuit 36 is connected via the correction data memory 37 to the graphic control circuit 34, that is, is fed back thereto.

Figure 2:
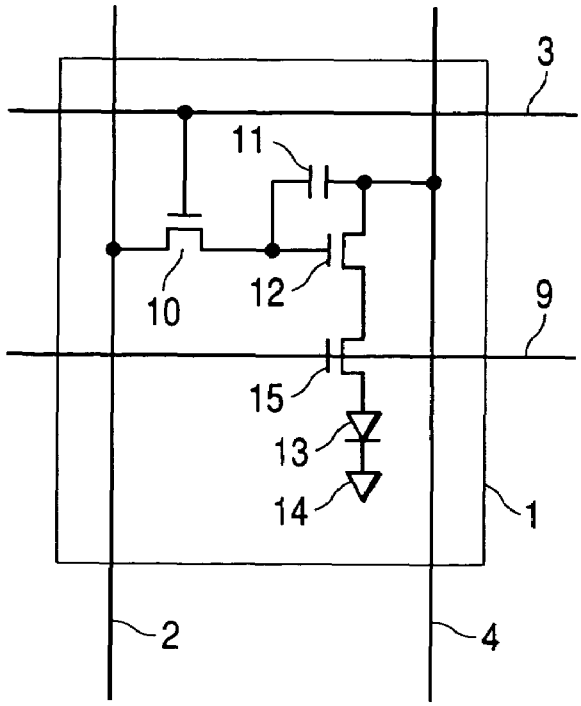
FIG. 2 is a circuit diagram for explaining an exemplary structure of a pixel in FIG. 1.

Explanation will next be made as to the structure of the above pixel 1. FIG. 2 is a circuit diagram for explaining an exemplary structure of the pixel 1 in FIG. 1. A pixel TFT 10 is connected at its one end to the signal line 2. A gate of the pixel TFT 10 is connected to the gate line 3, and the other end of the pixel TFT 10 is connected to a gate of a driving TFT 12.

The gate of the driving TFT 12 is also connected to one end of a capacitance 11. The other end of the capacitance 11 and an end of the driving TFT 12 are commonly connected to the power line 4. Another end of the driving TFT 12 is connected to one end of an on/off control switch 15, the other end of the on/off control switch 15 is connected to one end of an organic EL (electro-luminescence) light emitting element 13, and the other end of the light emitting element 13 is connected to a common grounding terminal 14. A gate of the on/off control switch 15 is connected to the on/off control line 9.

Figure 3:
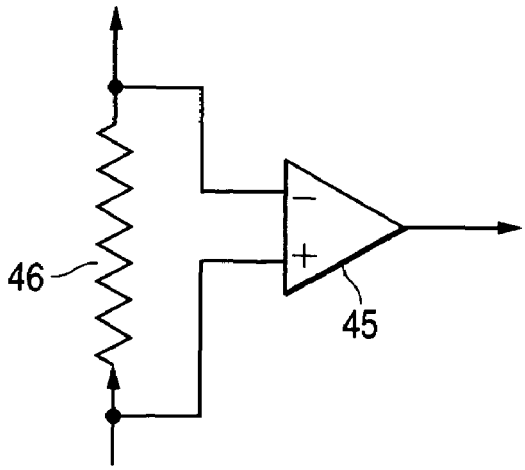
FIG. 3 is a circuit diagram for explaining an exemplary structure of a current measuring circuit in FIG. 1.

Explanation will then be made as to the arrangement of the current measuring circuit 7 in FIG. 1. FIG. 3 is a circuit diagram for explaining an exemplary arrangement of the current measuring circuit 7. A resistance element 46 is provided between input and output terminals of the current measuring circuit 7 shown in FIG. 1. Both ends of the resistance element 46 are connected to plus and minus terminals of a differential amplifier circuit 45. An output of the differential amplifier circuit 45 is input to the aforementioned A/D conversion circuit 36. In this connection, the structure of the differential amplifier circuit 45 implemented in a single crystal Si-LSI is generally well known and thus detailed explanation thereof is omitted here.

The operation of the embodiment 1 of the present invention shown in FIG. 1 will be explained. In a regular image display mode, a predetermined instruction saying, e.g., "decode radio data to display a reproduced image" is input to the CPU 31 from the input interface circuit 33 via the system bus 42. In response to the instruction input, the CPU 31 operates the radio interface circuit 30 and the frame memory 32, and transmits a necessary instruction and display data to the graphic control circuit 34. The graphic control circuit 34 in turn inputs a predetermined instruction and display data to the timing control circuit 35. The timing control circuit 35 converts the received instruction and data to a signal having a predetermined voltage amplitude to be directed to the polycrystalline Si-TFT circuit, transmits a timing clock to circuits provided on the glass substrate 41, and also transmits the display data to the signal voltage input circuit 6. The signal voltage input circuit 6 converts the received display data to an analog image signal voltage, and writes the converted voltage to the signal line 2. At this time, the first shift register circuit 5 scans the pixel 1 for the signal voltage to be written therein through the gate line 3 in synchronism with the line writing operation. During the above operation, power necessary for turning ON the pixel is supplied from the power supply circuit 8 to the power line 4.

Explanation will next be made as to the operation of the pixel shown in FIG. 2. During the output of the above analog image signal voltage onto the signal line 2, when the gate line 3 of the pixel 1 is selected and the pixel TFT 10 is turned on, the signal voltage is written in the capacitance 11. Even after the pixel TFT 10 is turned off, the written signal voltage is still stored in the capacitance 11. Thus the written signal voltage is always input to the driving TFT 12. As a result, a drive current corresponding to the written signal voltage is input to the light emitting element 13, so that the light emitting element 13 emits light with a brightness corresponding to the image signal voltage. However, the drive current of the light emitting element 13 is also modulated with the characteristic change of the light emitting element 13 so long as the characteristic of the light emitting element 13 is not ideal. During the above period, all the on/off changeover switches 22 are turned to their ON positions connected to the on/off line 20, whereby the on/off control switches 15 in all the pixels 1 are turned ON by the on/off control line 9 and fixed thereto.

Figure 4:
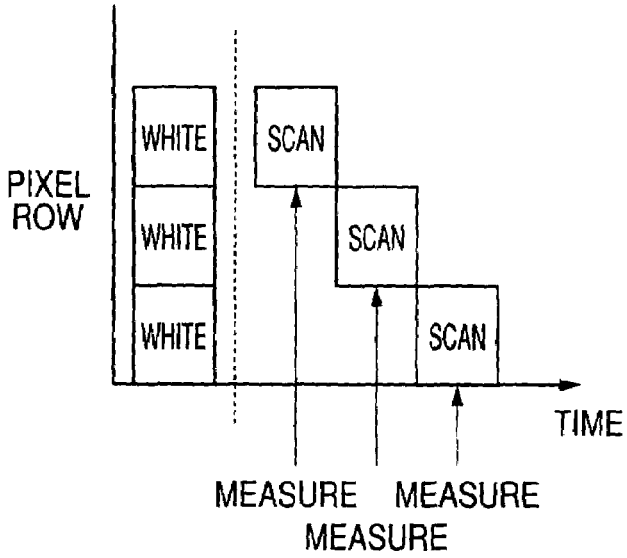
FIG. 4 is a model diagram for explaining a sequence of measuring a drive current in the first embodiment of the present invention.

The embodiment 1 has a function of measuring a change in the characteristic of each pixel on a real time basis, which operation will be explained by referring to FIG. 4. FIG. 4 is a model diagram for explaining a drive current measuring sequence in the embodiment 1 of the invention when a drive current for each pixel row is sequentially measured. In FIG. 4, abscissa denotes time, ordinate denotes pixel row, 'White' denotes writing of white level, 'Scan' denotes scan, and 'measure' denotes measurement timing.

First, in response to an instruction of the graphic control circuit 34 via the timing control circuit 35, all the on/off changeover switches 22 are turned ON, that is, turned to their positions connected to the second shift register circuit 21, so that the on/off control switches 15 of all the pixels 1 are fixedly turned OFF by the on/off control lines 9. Next, as shown in FIG. 4, the signal voltage of white level 'White' is collectively written from the signal voltage input circuit 6 to all the pixels 1. However, since the on/off control switches 15 of the pixels are already turned OFF, the writing of the white level signal voltage will cause the organic EL light emitting elements 13 not to be turned ON. At this time, the pixel TFTs 10 of all the pixels 1 are simultaneously opened and closed by the first shift register circuit 5. Thereafter, as shown in FIG. 4, the second shift register circuit 21 sequentially scans the on/off control lines 9 of the pixel rows (refer to 'Scan' in the drawing).

As a result, the on/off control switches 15 of the pixels 1 only on a selected row are turned ON, so that the drive current flowing through the organic EL light emitting element 13 can be measured by observing the output voltage of the differential amplifier circuit 45 at the current measuring circuit 7 (refer to 'measure' in the drawing). In this way, through the scanning of the second shift register circuit 21, drive current characteristics of all the pixels 1A can be measured. An output voltage of the differential amplifier circuit 45 thus obtained is converted by the A/D conversion circuit 36 to digital data, and then its compressed information is stored in the correction data memory 37. The graphic control circuit 34 acquires a degree of change in the organic EL light emitting element 13 in each pixel on the basis of the information stored in the correction data memory 37 in this manner, and uses its result as a coefficient to generate new correction data based on conversion information (measured drive current values) previously written in the data conversion table 38.

The coefficient is determined by the change of the drive current value and is used in the calculation of the display data to return the drive current value to its original value. when the drive current value is different from its original value, it is also possible to employ another technique for adding or subtracting a predetermined value to or from the display data and repeating this operation to apply a feedback to the display data value. By comparing with the coefficients, the difference can be fed back to the display data to be input to the timing control circuit 35, and a fixed pattern of noise resulting from a change in the organic EL light emitting element 13 can be canceled.

For the purpose of measuring drive current characteristics corresponding to one pixel row, it is sufficient only for the second shift register circuit 21 to turn ON and OFF the on/off control switches 15 and for the current measuring circuit 7 to measure the drive currents of the pixels. Further, the turning ON and OFF of the on/off control switch 15 can be carried out merely digitally and its operating time can be easily increased. For this reason, even when the drive current characteristics of the organic EL light emitting elements 13 for the full pixels are measured, the measurement can be sufficiently realized in a time as relatively short as one-frame or a fraction of a frame. Thus, it is also possible to measure variations in the above characteristics and to cancel the variations on a real time basis at an arbitrary frequency of, e.g., inter-frame or once per several frames while a motion image is displayed in the regular image display mode. Thereby the characteristic variation of the organic EL light emitting element 13 caused by the temperature change of the element due to its own light emission can also be canceled on a real time basis.

In the aforementioned embodiment 1, various modifications are possible in such a scope that the modifications will not impair the subject matter of the present invention. For example, although the glass substrate has been used as the TFT substrate in the embodiment 1, the glass substrate may be changed to another transparent insulating substrate such as a quartz substrate or a transparent plastic substrate. Further, the glass substrate may be an opaque substrate when the organic EL light emitting element 13 has a top emission structure.

Explanation of the number of pixels, a panel size, etc. is omitted in the embodiment 1. This is because the present invention is not limited, in particular, by such specifications or format. Further, it is assumed in the embodiment 1 that a display signal is of a 64-step gradation (6-bit) type. However, the number of gradation steps may be higher than 64 to increase the accuracy of the image signal voltage advantageously in the present invention.

Various modifications, changes, etc. are not limited to the present embodiment and can be basically applied even in other embodiments similarly.

Embodiment 2

A second embodiment of the present invention will be explained by referring to FIGS. 5 to 9. The present embodiment is basically the same as the embodiment 1 in the basic structure and operation, but is different from the embodiment 1 in a pixel circuit provided on a glass substrate and in a driving system therefor. Accordingly, attention will be directed only to the pixel circuit and the structure and operation thereof will be explained.

Figure 5:
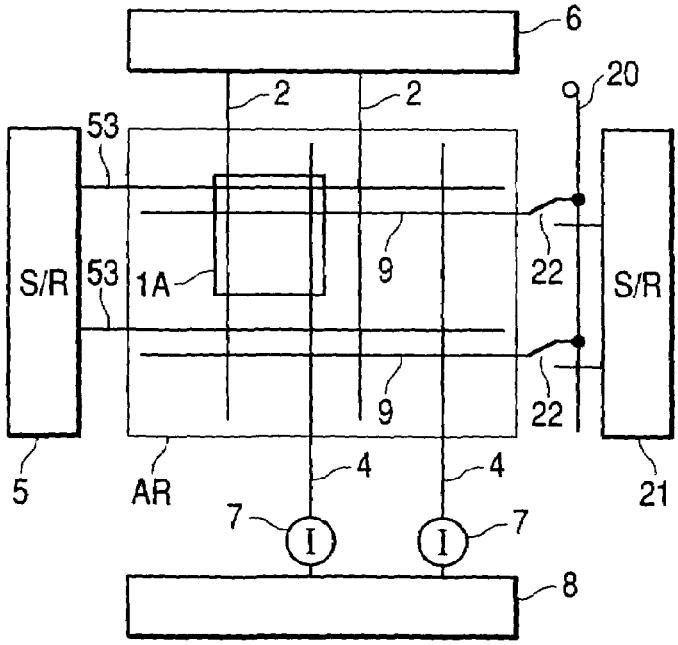
FIG. 5 is an arrangement of a pixel circuit in a portable terminal in accordance with a second embodiment of the present invention.

FIG. 5 is an arrangement of a pixel circuit in a portable terminal in accordance with a second embodiment of the present invention. Pixels 1A are provided in a display zone AR in the form of a matrix. A signal line 2,. a reset line 53, a power line 4, and an on/off control line 9 are connected to each pixel 1A. A multiplicity of such pixels 1A are actually provided in the display zone AR, but only one of the pixels is shown in FIG. 5 for simplicity of the drawing. One end of the signal line 2 is connected to a signal voltage input circuit 6. One end of the reset line 53 is connected to a first shift register circuit 5. One end of the power line 4 is connected to a power supply circuit 8 via a current measuring circuit 7. One end of the power line 4 is connected to a power supply circuit 8 via the current measuring circuit 7. One end of the on/off control line 9 is connected to a second shift register circuit 21 via an on/off changeover switch 22. The other end of the on/off changeover switch 22 is connected to an on/off line 20. In this example, the pixels 1A, signal voltage input circuit 6, first shift register circuit 5, on/off changeover switch 22, and second shift register circuit 21 are provided on a glass substrate using polycrystalline Si-TFTs.

Figure 6:
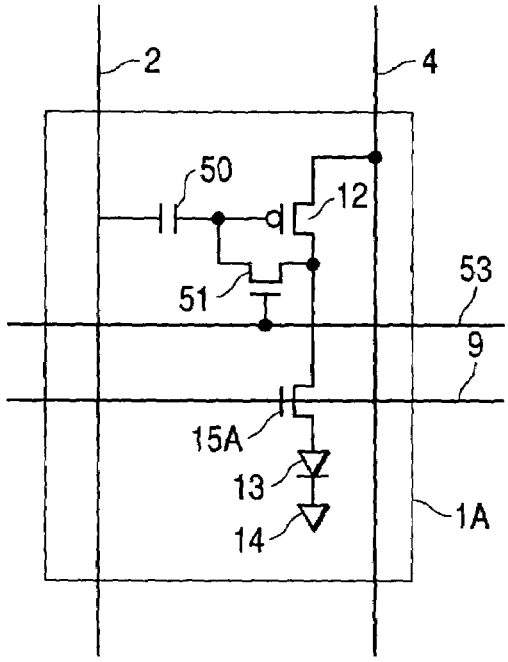
FIG. 6 is a circuit diagram for explaining a structure of a pixel in FIG. 5.

Explanation will then be made as to the structure of the pixel 1A. FIG. 6 is a circuit diagram for explaining the structure of the pixel 1A in FIG. 5. In FIG. 6, one end of a capacitance 50 is connected to the signal line 2, and the other end of the capacitance 50 is connected to a gate of a driving TFT 12. A source of the driving TFT 12 is connected to the power line 4. A drain of the driving TFT 12 is connected to one end of an on/off control switch 15A having a gate connected to the on/off control line 9. The other end of the on/off control switch 15A is connected to one end of an organic EL light emitting element 13. The other end of the organic EL light emitting element 13 is connected to a common grounding terminal 14. A reset switch 51 having a gate connected to the reset line 53 is connected between the gate and drain of the driving TFT 12.

Explanation will next be made as to the operation of the embodiment 2 with reference to FIG. 7. The regular image display operation of the embodiment 2 is divided into two periods, that is, one wherein an analog image signal voltage is written into a group of pixels 1A and the other wherein the voltage is displayed. The operation of the signal voltage write period will be first explained.

As in the embodiment 1, the signal voltage input circuit 6 converts transmitted display data into an analog image signal voltage and writes the converted voltage to the signal line 2. At this time, in synchronism with the writing operation, the first and second shift register circuit 5 and 21 scan the pixel 1A in which the signal voltage is to be written via the reset line 53 and the on/off control line 9 respectively. Necessary power is supplied from the power supply circuit 8 to the power line 4. All the on/off changeover switches 22 are always turned on, that is, are turned to their positions connected to the second shift register circuit 21.

Figure 7:
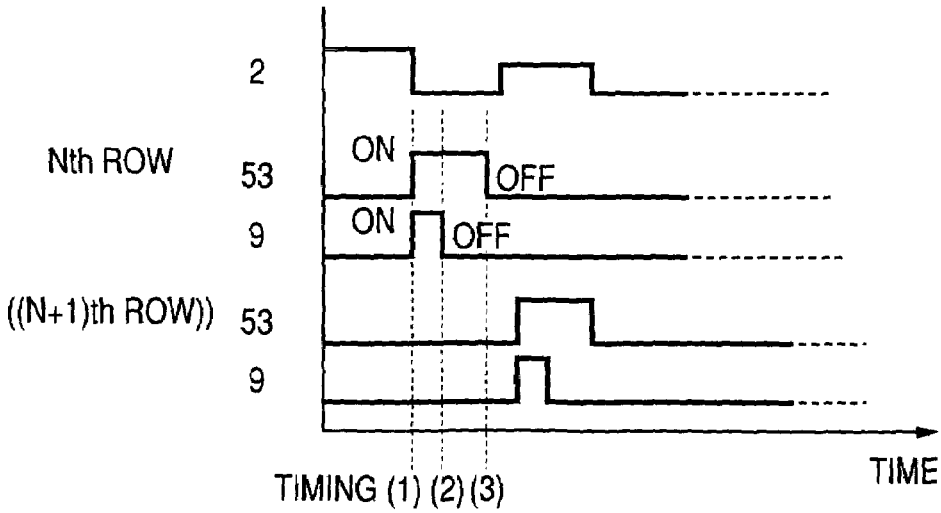
FIG. 7 is an operational timing chart of signals of a signal line, a reset line, and an on/off control line in pixels in a signal voltage write period, for explaining the second embodiment of the present invention.

FIG. 7 is a timing chart showing the operation of the signal voltage write period of the on/off control line 9, in which abscissa denotes time and operational timing is shown by timing (1), (2) and (3). In the drawing, further, ordinate denotes on/off waveforms of signals on the signal line 2, reset line 53, and on/off control line 9 with respect to Nth row and (N+1)th row. In the illustrated timing chart, the voltage of the signal line 2 is shown to be high in its upper side, the voltages of the reset line 53 and on/off control line 9 are shown to be switched ON in their upper side and switched OFF in their lower side. During the output of the above analog image signal voltage to the signal line 2, when the reset line 53 of the pixel 1A is selected at the timing (1) in FIG. 7, the reset switch 51 short-circuits the gate and drain of the driving TFT 12. That is, the driving TFT 12 is diode connected. At this time, the on/off control switch 15A is also turned ON by the on/off control line 9. Thus the organic EL light emitting element 13 is connected to the driving TFT 12 so that the drive current of the organic EL light emitting element 13 flows through the driving TFT 12.

Next, when the on/off control switch 15A is turned OFF by the on/off control line 9 at the timing (2) of FIG. 7, the driving TFT 12 is disconnected from the organic EL light emitting element 13. And at the time moment that the gate and drain of the driving TFT 12 reach a threshold voltage Vth of the driving TFT 12, the flow of a channel current of the driving TFT 12 stops.

When the reset line 53 is turned OFF at the timing (3) of FIG. 7, the aforementioned analog image signal voltage is applied to one end of the capacitance 50, the threshold voltage Vth of the driving TFT 12 is output to the other end of the capacitance 50, and a potential difference across the capacitance is stored in the capacitance 50. After the above writing operation is repeated for all the pixels, the writing period is terminated.

Figure 8:
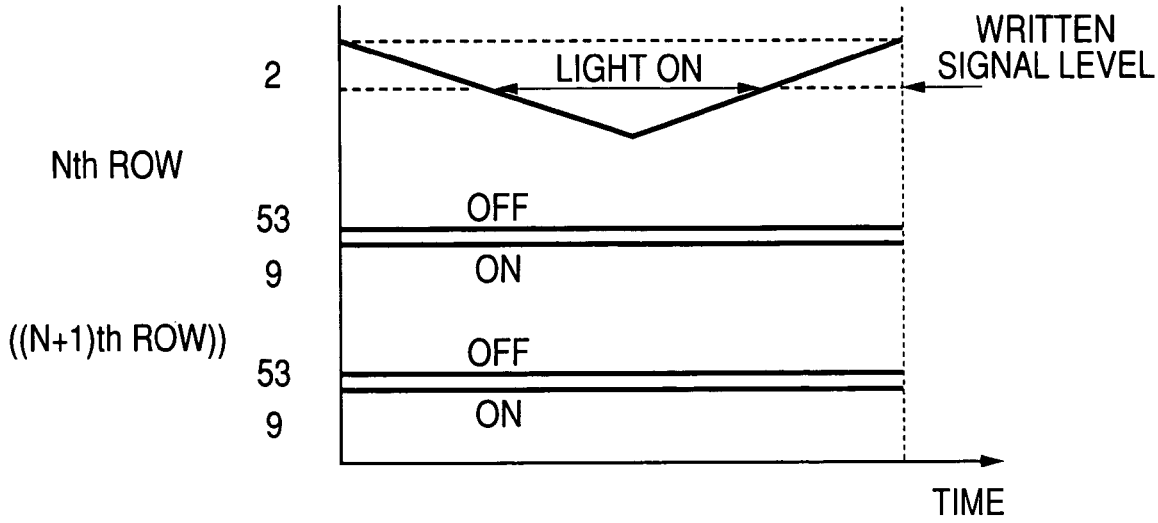
FIG. 8 is an operational timing chart of the signals of the signal line, reset line, and on/off control line in the pixels in a display period, for explaining the second embodiment of the present invention.

The operation of the display period will next be explained. FIG. 8 shows an operational timing chart in the display period of the signal line 2, reset line 53, and on/off control line 9 in the pixel 1A. Even in the timing chart similarly to FIG. 7, the voltage signal of the signal line 2 is shown to be high in its upper side, the signals of the reset line 53 and an on/off control line 9 are shown to be switched ON in their upper side and be switched OFF in their lower side. In the drawing, abscissa and ordinate denote the same time and waveforms of signals as in FIG. 7, 'Light on' denotes a light emission period by a signal applied to the signal line 2, and 'Written signal level' denotes the light emission level of the organic EL element. In the display period, all the on/off changeover switches 22 are turned ON, i.e., are turned to positions connected to the on/off line 20, whereby the on/off control switches 15A of all the pixels 1A are fixedly turned always ON by the on/off control line 9. At this time, the organic EL light emitting element 13 is connected to the driving TFT 12 so that the drive current of the organic EL light emitting element 13 can flow through the driving TFT 12 though it depends on the gate voltage.

At this time, the signal voltage input circuit 6 writes a single triangular sweep voltage waveform to the signal line 2 as shown in FIG. 8. When the single triangular sweep voltage waveform is output to the signal line 2, the capacitance 50 having a predetermined potential difference stored therein in the write period functions to turn ON the driving TFT 12 only in a predetermined period and to drive the organic EL light emitting element 13. This is because a voltage higher than the threshold voltage Vth is generated at the gate of the driving TFT 12 while the triangular sweep voltage applied to the signal line 2 is higher than the analog image signal voltage written in the write period, thus putting the driving TFT 12 in the OFF state. While the triangular sweep voltage applied to the signal line 2 is lower than the analog image signal voltage written in the write period, a voltage lower than the threshold voltage Vth is generated at the gate of the driving TFT 12, thus putting the driving TFT 12 in the ON state.

In this way, when the organic EL light emitting element 13 is turned ON only in the period of the analog image signal voltage value in the embodiment 2, gradation emission can be realized with an average brightness corresponding to the image signal voltage. In this case, the driving TFT 12 forms an inverter circuit having the organic EL light emitting element 13 as its load. For details of its related arts, refer to the early-mentioned JP-A-2003-5709 and JP-A-2003-122301.

Even the above embodiment 2 has a function of measuring a change in the characteristic of each pixel on a real time basis. The operation when the change of the pixel characteristic is measured on a real time basis is basically the same as that in the first embodiment explained using FIG. 4. In this case, the operation will be explained as to specific drive waveforms of signals using FIG. 9.

Figure 9:
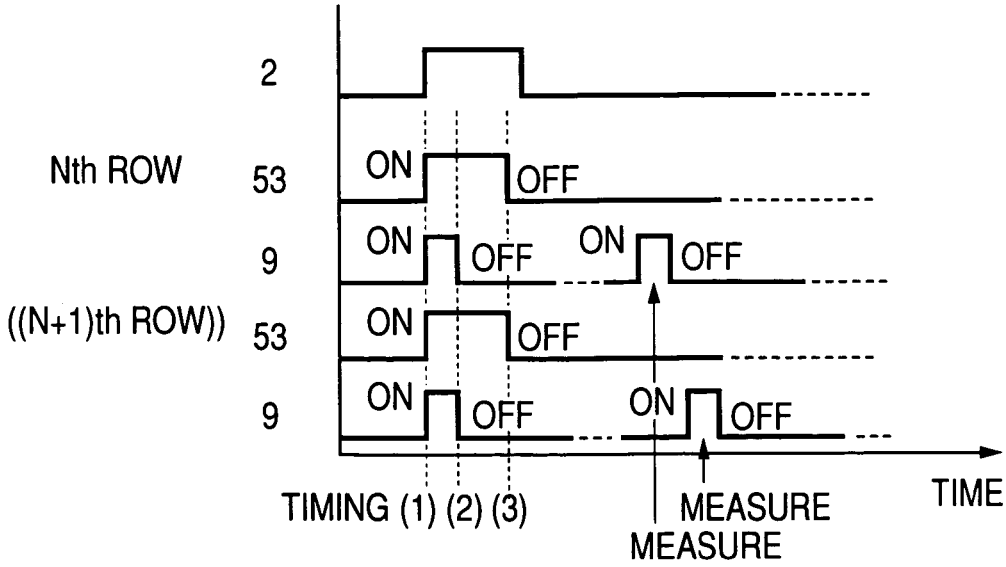
FIG. 9 is an operational timing chart of the signals of the signal line, reset line, and on/off control line in the pixels in a drive current measurement period, for explaining the second embodiment of the present invention.

FIG. 9 is an operational timing chart showing waveforms of signals of the signal line 2, reset line 53, and on/off control line 9 in the pixel 1A. Even in this timing chart, the voltage of the signal line 2 is shown to be high in its upper side, the signals of the reset line 53 and on/off control line 9 are shown to be switched ON in their upper side and switched OFF in their lower side. The meaning of the abscissa, ordinate, and signal waveforms is the same as that in FIG. 7.

Upon measuring a change in the pixel characteristic, white level is first collectively written in all the pixels 1A at the timing (1) in FIG. 9. At this time, an image signal voltage corresponding to the white level is input to the signal line 2, and simultaneously with it, the reset lines 53 of all the pixels 1A are selected. At this time, all the on/off changeover switches 22 are turned to ON positions connected to the on/off line 20, and the on/off control switches 15 of all the pixels 1 are controllably turned ON by the on/off control line 9. In each pixel, the reset switch 51 short-circuits between the gate and drain of the driving TFT 12. In other words, the driving TFT 12 is diode connected at this time.

Since the on/off control switch 15A is also turned ON by the on/off control line 9 at this time, the organic EL light emitting element 13 is connected to the driving TFT 12 so that the drive current of the organic EL light emitting element 13 flows through the driving TFT 12. At the timing (2) in FIG. 9, next, all the on/off changeover switches 22 are turned to ON positions connected to the second shift register circuit 21, and the on/off control switches 15A of all the pixels 1 are controllably once turned OFF by the on/off control line 9. When the on/off control switch 15A is turned OFF, the driving TFT 12 is disconnected from the organic EL light emitting element 13. And at the time moment that the gate and drain of the driving TFT 12 reach the threshold voltage Vth of the driving TFT 12, the flowing of a channel current of the driving TFT 12 is stopped. When the reset line 53 is turned OFF at the timing (3) in the drawing, the above analog image signal voltage is input to one end of the capacitance 50, the threshold voltage Vth of the driving TFT 12 is output to the other end of the capacitance 50, and a potential difference across the capacitance is stored in the capacitance 50.

Thereafter, the current value of each pixel is measured for each row. At this time, the on/off control lines 9 are sequentially scanned by the second shift register circuit 21 via the on/off changeover switch 22. In the row of the scanned pixels 1A, the on/off control switch 15A is turned ON. Thus the organic EL light emitting element 13 is connected to the driving TFT 12, so that the drive current of the organic EL light emitting element 13 flows through the driving TFT 12. At this time, the signal voltage input circuit 6 writes a voltage corresponding to the lowest voltage or less of the triangular sweep voltage to the signal line 2. In this case, the capacitance 50 functions to turn ON the driving TFT 12 for a predetermined period and to drive the organic EL light emitting element 13. This is because the voltage applied to the signal line 2 is smaller than the written analog image signal voltage, so that a voltage smaller than the threshold voltage Vth is generated at the gate of the driving TFT 12, thus putting the driving TFT 12 always in the ON state.

Since a voltage nearly equal to the voltage of the power line 4 is applied to the organic EL light emitting element 13 via the on/off control switch 15A at this time, a current corresponding to the characteristic change of the organic EL light emitting element 13 flows therethrough. At this time, a drive current flowing through the organic EL light emitting element 13 is measured by observing the output voltage of the current measuring circuit 7.

Even in the embodiment 2, the drive current characteristics of all the pixels 1A can be measured through the scanning of the second shift register circuit 21 in this manner. The output voltage of the current measuring circuit 7 thus obtained is A/D converted, compressed, and stored in the correction data memory. And the graphic control circuit acquires a degree of change in the organic EL light emitting element 13 in each pixel on the basis of information stored in the correction data memory, the acquired result is compared with conversion information previously written in the data conversion table, and fed back to display data to be input to the timing control circuit. As a result, a fixed pattern of noise resulting from a change in the organic EL light emitting element 13 can be canceled, as in the first embodiment.

In the embodiment 2, since the organic EL light emitting element 13 is driven by a nearly constant voltage of the power line 4, the quantity of characteristic change of the organic EL light emitting element 13 can be easily obtained based on the drive current flowing through the organic EL light emitting element 13.

Embodiment 3

Explanation will be made as to a third embodiment of the present invention by referring to FIGS. 10 and 11. The basic arrangement and operation. of a portable terminal in accordance with the third embodiment of the invention are substantially the same as those of the embodiment 1 already explained, and are different from those of the embodiment 1 only in the current measuring circuit and a driving system therefor. Thus, attention is directed only to the current measuring circuit part, and the structure and operation thereof will be explained.

Figure 10:
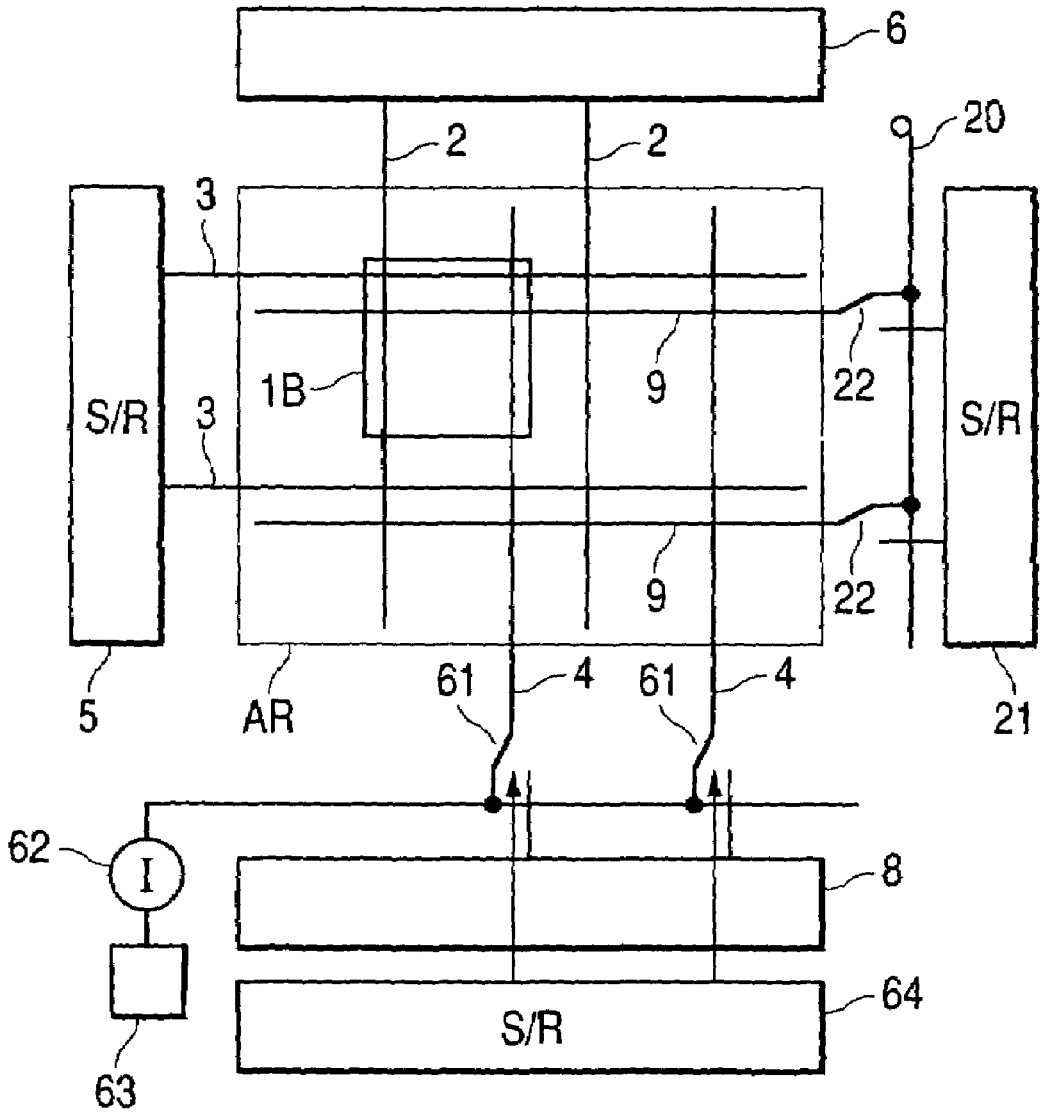
FIG. 10 is a model diagram of a pixel circuit in a portable terminal to which a third embodiment of the present invention is applied.
Figure 11:
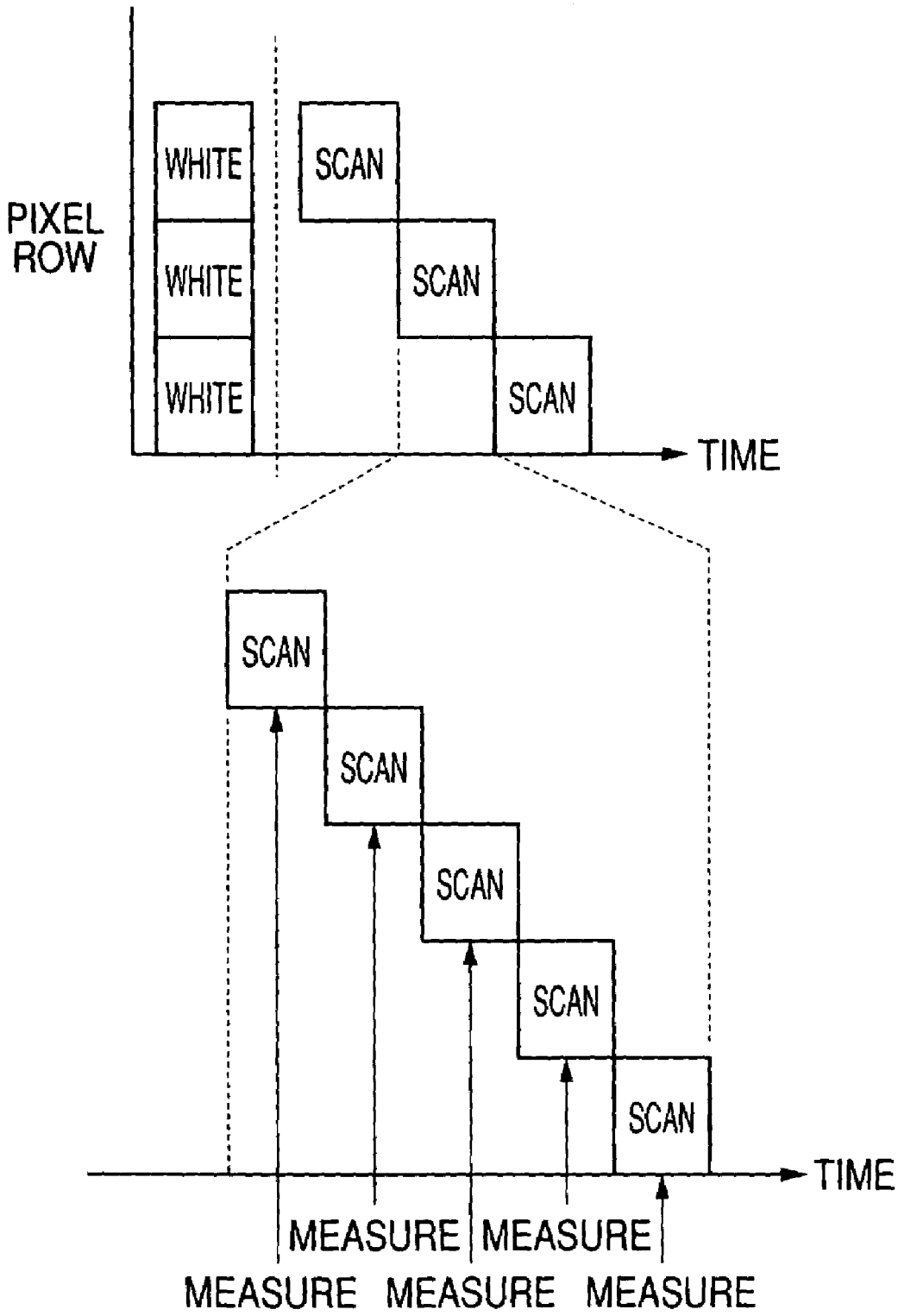
FIG. 11 is a model diagram similar to FIG. 4 for explaining a sequence of sequentially measuring a drive current of each pixel in a third embodiment of the present invention.

FIG. 10 is an arrangement of a pixel zone part in a portable terminal to which the embodiment 3 of the invention is applied. Pixels 1B are provided in a display zone AR in the form of a matrix. A signal line 2, a gate line 3, a power line 4, and an on/off control line 9 are connected to each pixel 1B. A multiplicity of such pixels 1B are actually provided in the display zone AR, but only one of the pixels is shown in FIG. 10 for simplicity of the drawing. One end of the signal line 2 is connected to a signal voltage input circuit 6. One end of the signal line 2 is connected to a first shift register circuit 5. One end of the power line 4 is connected to a power supply circuit 8 via a power changeover switch 61, and another end of the power changeover switch 61 is connected to a current measuring power supply 63 via a current measuring circuit 62. In this example, the power changeover switch 61 is scanned by a third shift register circuit 64.

One end of the on/off control line 9 is connected to a second shift register circuit 21 via an on/off changeover switch 22, and another end of the on/off changeover switch 22 is connected to an on/off line 20. In the illustrated example, the pixels 1B, signal voltage input circuit 6, first shift register circuit 5, on/off changeover switch 22, and second shift register circuit 21 are provided on a glass substrate using polycrystalline Si-TFTs.

Since the operation of the embodiment 3 is basically the same as that of the embodiment 1, explanation will be made as to the operation of the current measuring circuit as a feature of the embodiment 3 by referring to FIG. 11. FIG. 11 is a model diagram similar to FIG. 4, for explaining a sequence when a drive current is sequentially measured for each pixel. As shown in FIG. 11, first of all, a signal voltage 'White' of a white level is written collectively in all the pixels 1B from the signal voltage input circuit 6. Next, the second shift register circuit 21 sequentially scans the on/off control lines 9 for each pixel row, whereby a drive current flowing through the organic EL light emitting element 13 of the pixel 1B is measured only for a selected row. This is similar to in the embodiment 1.

In the embodiment 3, however, when a drive current is measured for a selected row, the power changeover switch 61 connected to the power line 4 is scanned by the third shift register circuit 64 to sequentially connect the power line 4 to the current measuring power supply 63 via the current measuring circuit 62. In this way, the embodiment 3 is featured by switching the single current measuring circuit 62 for the current measurement. At this time, by observing the output voltage of the current measuring circuit 62, a drive current flowing through the organic EL light emitting element 13 is measured. Even in the embodiment 3, by scanning the second and third shift register circuits 21 and 64 in this way, the drive current characteristics of all the pixels 1B can be measured.

And as in the embodiment 1, the output voltage of the current measuring circuit 62 thus obtained is A/D converted, compressed and stored in the correction data memory, the graphic control circuit acquires a degree of change in the driving TFT 12 in each pixel from information stored in the correction data memory, its acquired result is compared with conversion information previously written in the data conversion table, whereby a feedback is applied to display data to be input to the timing control circuit to cancel a fixed pattern of noise resulting from the change of the organic EL light emitting element 13.

The embodiment 3 has an advantage that the need of providing many of the current measuring circuits 62 can be eliminated or the need of considering variations among the current measuring circuits 62 can be removed.

Embodiment 4

Explanation will be made as to a fourth embodiment of the present invention with reference to FIG. 12. The basic structure and operation of a portable terminal to which the present invention is applied, are similar to those in the embodiment 1 already explained. However, the embodiment 4 is different from the embodiment 1 only in a pixel structure and a drive system therefor. Accordingly, attention is directed to only a pixel circuit part (pixel 1C) and the structure and operation thereof will be explained.

Figure 12:
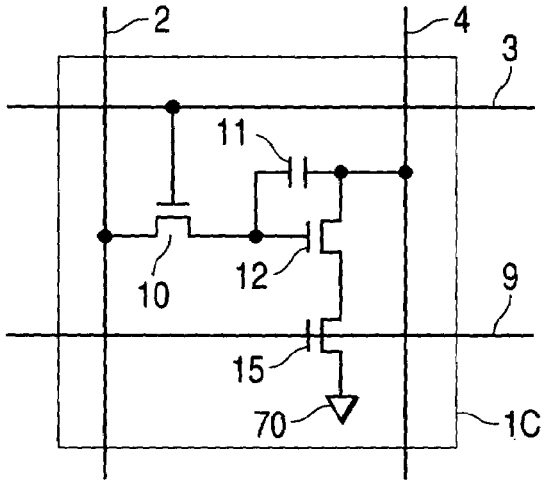
FIG. 12 is a circuit diagram for explaining an exemplary structure of a pixel in a fourth embodiment of the present invention.
Figure 13:
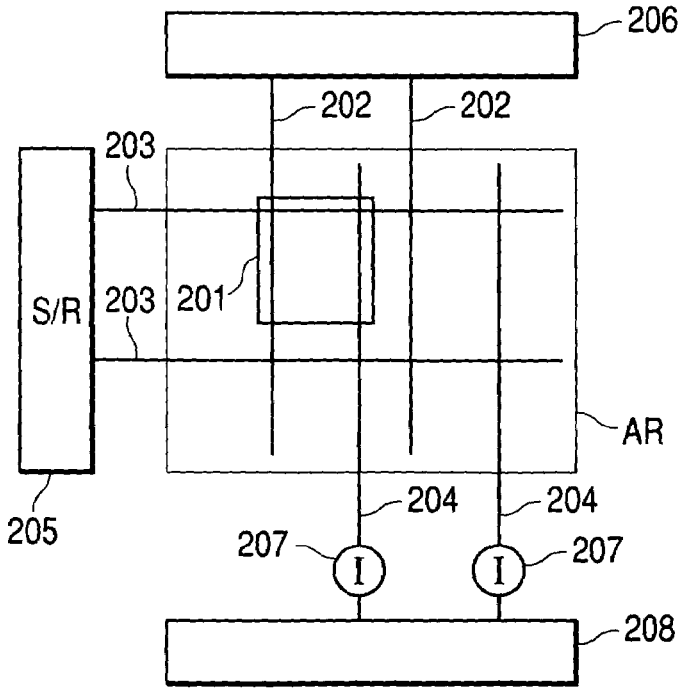
FIG. 13 is an arrangement of a prior art luminous display device.
Figure 14:
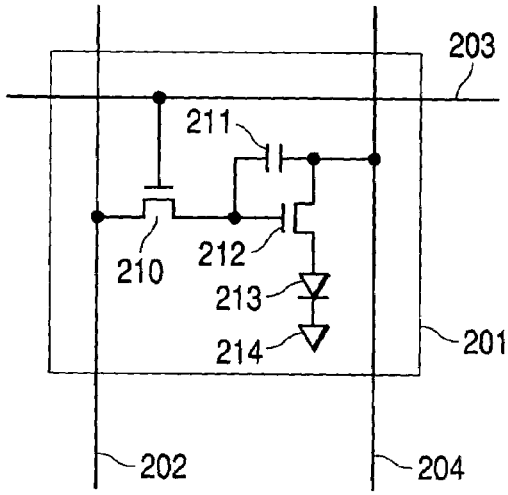
FIG. 14 is a diagram for explaining an exemplary structure of a pixel in FIG. 13.
Figure 15:
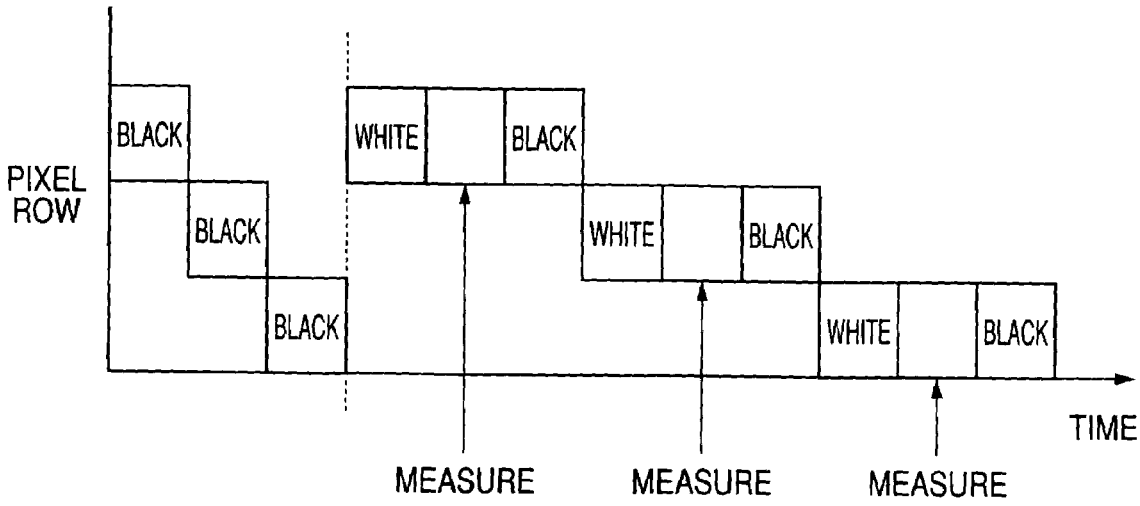
FIG. 15 is a model diagram for explaining a sequence of measuring a drive current for each pixel row.

FIG. 12 is a circuit diagram for explaining an exemplary structure of a pixel 1C in the embodiment 4 of the invention. In FIG. 12, one end of a pixel TFT 10 is connected to a signal line 2, a gate of the pixel TFT 10 is connected to a gate line 3, and the other end of the pixel TFT 10 is connected to a gate of the driving TFT 12. one end of a capacitance 11 is connected to the gate of the driving TFT 12, and the other end of the capacitance 11 and one end of the driving TFT 12 are commonly connected to a power line 4. The other end of the driving TFT 12 is connected to one end of an on/off control switch 15, and the other end of the on/off control switch 15 is connected to an electron emission source 70 having a carbon nanotube coated thereon. Though not illustrated, a common substrate having a phosphor is provided downstream of the electron emission source 70 via an inert gas zone, and a predetermined voltage is previously applied to the common substrate. The gate of the on/off control switch 15 is connected to the on/off control line 9.

Explanation will next be made as to the operation of the pixel 1C shown in FIG. 12. During output of an analog image signal voltage to the signal line 2, when the gate line 3 of the pixel 1C is selected and the pixel TFT 10 is turned ON, the signal voltage is written in a capacitance 11. Even after the pixel TFT 10 is turned OFF, the written signal voltage is stored in the capacitance 11. This means that the written signal voltage is always input to the driving TFT 12. As a result, a drive current corresponding to the written signal voltage is input to the electron emission source 70, so that the electron emission source 70 causes the phosphor on the common grounding substrate to emit light with a brightness corresponding to the image signal voltage. During the above period, all the on/off changeover switches 22 are turned to ON positions connected to the on/off line 20, whereby the on/off control switches 15 of all the pixels 1C are fixedly turned ON by the on/off control line 9.

In the embodiment 4, a combination of the electron emission source 70 capable of suitably increasing brightness and surface area and a phosphor is used as a phosphor. In the present embodiment, a change in the characteristic of the electron emission source 70 can be detected on a real time basis, and thus there can be realized a high-brightness, large-surface-area display device which has a stable luminous brightness.

In accordance with the present invention, there can be provided an image display device which is suitably used not only for a high-quality image portable terminal such as a portable telephone having a stable luminous brightness but also for various sorts of information terminals including a personal computer, a television receiver or other electronic equipment.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. An image display device comprising:

pixels arranged in a matrix;

signal lines;

gate lines;

power lines;

on/off control lines;

a signal voltage input circuit;

on/off changeover switches;

a first shift register circuit;

a second shift register circuit;

current measuring circuits; and a power supply circuit, wherein each pixel comprises a pixel transistor, a capacitor, a driving transistor, an on/off control switch, and a light emitting element, a gate of a pixel transistor in each pixel located in the same row is connected to the same gate line among the gate lines, a gate of an on/off control switch in each pixel located in the same row is connected to the same on/off control line among the on/off control lines, a gate of a driving transistor and a first end of a capacitor in each pixel located in the same column is connected to the same signal line among the signal lines through a source-drain path of a pixel transistor in each pixel located in the same column, a second end of a capacitor in each pixel located in the same column is connected to the same power line among the power lines, each light emitting element is connected between the power line and a common terminal through a source-drain path of the driving transistor and a source-drain path of the on/off control switch in each pixel, the power lines are connected to the power supply circuit through the current measuring circuits, the second shift register circuit turns off all the on/off control switches through the on/off control lines, the first shift register circuit turns on all the pixel transistors through the gate lines while the signal voltage input circuit inputs signal voltages of a white level into all the signal lines, and then the first shift register circuit turns off the pixel transistors through the gate lines, the second shift register circuit sequentially scans the on/off control lines, and the current measuring circuits measure drive currents of the power supply lines.

2. The image display device according to claim 1, wherein each of the current measuring circuits comprises a resistance element and a differential amplifier circuit, the resistance element is connected between an input terminal and an output terminal of each of the current measuring circuits, and a first end and a second end of the resistance element are respectively connected to a plus terminal and a minus terminal of the differential amplifier circuit.

3. The image display device according to claim 1, wherein a signal drive circuit feeds back the signal voltage based on the measured drive current.

4. The image display device according to claim 1, wherein the light emitting element is either one of an organic EL and an electron emission source coated with carbon nanotubes.

5. An image display device comprising:

pixels arranged in a matrix;

signal lines;

reset lines;

power lines;

on/off control lines;

a signal voltage input circuit;

a first shift register circuit;

a second shift register circuit;

current measuring circuits; and a power supply circuit, wherein each pixel comprises a driving transistor, a capacitor, a reset transistor, an on/off control transistor, and a light emitting element, a gate of a reset transistor in each pixel located in the same row is connected to the same reset line among the reset lines, a gate of an on/off control switch in each pixel located in the same row is connected to the same on/off control line among the on/off control lines, a gate of a driving transistor in each pixel located in the same column is connected to the same signal line among the signal lines through the capacitor, a source-drain path of the reset transistor is connected between a gate and a drain of the driving transistor, the light emitting element is connected between the power line and a common terminal through a source-drain path of the driving transistor and a source-drain path of the on/off control transistor, the power lines are connected to the power supply circuit through the current measuring circuits, when the first shift register circuit turns on all the reset transistors through the reset lines while the signal voltage input circuit inputs signal voltages of a white level into all the signal lines, all the on/off control switches are turned on, then the second shift register circuit turns off all the on/off control transistors, and then the first shift register circuit turns off all the reset transistors, the second shift register circuit sequentially scans the on/off control lines, and the current measuring circuits measure drive currents of the power supply lines.

6. The image display device according to claim 5, wherein each of the current measuring circuits comprises a resistance element and a differential amplifier circuit, the resistance element is connected between an input terminal and an output terminal of each of the current measuring circuits, and a first end and a second end of the resistance element are respectively connected to a plus terminal and a minus terminal of the differential amplifier circuit.

7. The image display device according to claim 5, wherein a signal drive circuit feeds back the signal voltage based on the measured drive current.

8. The image display device according to claim 5, wherein the light emitting element is either one of an organic EL and an electron emission source coated with carbon nanotubes.

9. An image display device comprising:

pixels arranged in a matrix;

signal lines;

gate lines;

power lines;

on/off control lines;

a signal voltage input circuit;

a first shift register circuit;

a second shift register circuit;

a third shift register circuit;

current measuring circuits;

a power supply circuit; and power changeover switches;

wherein each pixel comprises a pixel transistor, a capacitor, a driving transistor, an on/off control transistor, and a light emitting element, a gate of a pixel transistor in each pixel located in the same row is connected to the same gate line among the gate lines, a gate of an on/off control switch located in pixels in the same row is connected to the same on/off control line among the on/off control lines, a gate of a driving transistor and a first end of the capacitor in each pixel located in the same column are connected to the same signal line among the signal lines through a source-drain path of a pixel transistor in each pixel located in the same column, a second end of the capacitor in each pixel located in the same column are connected to the same power line among the power lines, a light emitting element is connected between the power line and the common terminal through a source-drain path of the driving transistor and a source-drain path of the on/off control transistor, the power lines are connected to the power supply circuit through the current measuring circuits, the power changeover switches are connected between the power lines and the power supply circuit, the second shift register circuit turns off all the on/off control switches through the on/off control lines, the first shift register circuit turns on all the pixel transistors through the gate lines while the signal voltage input circuit inputs signal voltages of a white level into all the signal lines, and then the first shift register turns off all the pixel transistors through the gate lines, the second shift register circuit sequentially scans the on/off control lines and the third shift register circuit sequentially scans the power changeover switches to connect a selected power line to the power supply circuit via a corresponding current measuring circuit, and the corresponding current measuring circuit measures a drive current of the selected power supply line.

10. The image display device according to claim 9, wherein each of the current measuring circuit comprises a resistance element and a differential amplifier circuit, the resistance element is connected between an input terminal and an output terminal of each of the current measuring circuit, and a first end and a second end of the resistance element are respectively connected to a plus terminal and a minus terminal of the differential amplifier circuit.

11. The image display device according to claim 9, wherein the signal drive circuit feeds back the signal voltage based on the measured drive current.

12. The image display device according to claim 9, wherein the light emitting element is either one of an organic EL and an electron emission source coated with carbon nanotubes.

* * * * *